US009117457B2

(12) United States Patent
Kwan et al.

(10) Patent No.: US 9,117,457 B2
(45) Date of Patent: Aug. 25, 2015

(54) COMPACT PLUG-IN NOISE CANCELLATION DEVICE

(71) Applicant: Signal Processing, Inc., Rockville, MD (US)

(72) Inventors: Chiman Kwan, Rockville, MD (US); Jin Zhou, North Potomac, MD (US)

(73) Assignee: Signal Processing, Inc., Rockville ( * ) Notice: Subject to any disclaimer, the term of this patent is extended or adjusted under 35 U.S.C. 154(b) by 338 days.

(21) Appl. No.: 13/779,994

(22) Filed: Feb. 28, 2013

(65) Prior Publication Data

US 2014/0243048 A1 Aug. 28, 2014

(51) Int. Cl.
*G10L 21/0208* (2013.01)
*G10L 21/0216* (2013.01)

(52) U.S. Cl.
CPC ... *G10L 21/0208* (2013.01); *G10L 2021/02165* (2013.01)

(58) Field of Classification Search
CPC ..... G10L 21/0208; G10L 21/02085; G10L 21/0216; G10L 21/0232; G10L 21/0272; G10L 21/028; G10L 2021/02165; G10K 11/16; H04R 1/1083
See application file for complete search history.

(56) References Cited

U.S. PATENT DOCUMENTS

| | | | | |
|---|---|---|---|---|
| 5,812,678 | A * | 9/1998 | Scalise et al. | 381/67 |
| 7,206,418 | B2 * | 4/2007 | Yang et al. | 381/92 |
| 7,209,567 | B1 * | 4/2007 | Kozel et al. | 381/94.3 |
| 2009/0012783 | A1 * | 1/2009 | Klein | 704/226 |
| 2009/0051312 | A1 * | 2/2009 | Simon et al. | 320/103 |
| 2009/0323982 | A1 * | 12/2009 | Solbach et al. | 381/94.3 |
| 2010/0226491 | A1 * | 9/2010 | Conte et al. | 379/406.01 |
| 2013/0016854 | A1 * | 1/2013 | Zheng et al. | 381/94.7 |
| 2013/0188807 | A1 * | 7/2013 | Slotte | 381/99 |
| 2014/0126745 | A1 * | 5/2014 | Dickins et al. | 381/94.3 |

* cited by examiner

*Primary Examiner* — Brenda Bernardi
(74) *Attorney, Agent, or Firm* — Ming Chow; Sinorica, LLC

(57) ABSTRACT

A noise cancellation device (NCD) comprises a microphone, an analog-to-digital converter, a digital-to-analog converter, a rechargeable battery, and a processor. The NCD acquires an audio input, from an external device such as a stethoscope or a cell phone, and passes the analog data into an ADC (analog-to-digital converter) for signal conversion. The digitized signals are then passed to the processor for further processing. The processor contains all the processing functions such as preprocessing (divide the input data into frames and apply shaping function to each frame), short term Fourier transform (STFT), adaptive filtering, inverse STFT, and signal synthesis.

2 Claims, 7 Drawing Sheets

COMPACT PLUG-IN NOISE CANCELLATION DEVICE

GOVERNMENT LICENSE RIGHTS

This invention was made with government support under contract number

N68335-11-C-0326 award by NAVAL AIR WARFARE CTR AIRCRAFT DIVISION. The government has certain rights in the invention.

BACKGROUND

1. Field of the Invention

The present invention generally relates to signal enhancement in noisy environments, and more particularly, relates to a compact plug-in noise cancellation device that can filter out background noises and retain useful signals.

2. Description of the Prior Art

Signal enhancement may be desired in many applications. For instance, it may be difficult for a doctor to perform auscultation in noisy environments such as ambulance, construction sites, and factories, as background noise will overwhelm a patient's internal body sounds such as heartbeat. It may be hard for a person to make a phone call in noisy environments such as restaurants, conference halls, and streets with a lot of traffic. Also, when soldiers call for close air support (CAS), they are normally very near the frontline where mortar explosions, machine guns, and other types of background noises are overwhelming. Communication quality is compromised in these noisy environments and thus effective signal enhancement is needed to improve the signal-to-noise ratio (SNR) so as to achieve satisfactory communication quality.

Conventional signal enhancement techniques have reasonably good performance when the background noise is stationary, but if background noise is intermittent or non-stationary, then the noise suppression performance is not good. Moreover, conventional signal enhancement techniques cannot deal with intermittent and large amplitude noise where the SNR may be less than zero, that is, the amplitude of the useful signal is much less than that of the background noise. Therefore, it is desirable to have a compact, lightweight and low lost plug-in noise cancellation device that can effectively suppress various kinds of background noises and retain useful signals such as heartbeat in auscultation and speech in phone communications.

SUMMARY OF THE INVENTION

The current invention is a noise cancellation device (NCD) that comprises of a microphone, an analog-to-digital converter (ADC), a digital-to-analog converter (DAC), a rechargeable battery, and a processor. The NCD acquires an audio input, from an external device such as a stethoscope or a cell phone, and passes the analog data into an ADC for signal conversion. The digitized signals are then passed to the processor for further processing. The processor contains all the processing functions such as preprocessing (divide the input data into frames and apply shaping function to each frame), short term Fourier transform (STFT), adaptive filtering, inverse STFT, and signal synthesis.

BRIEF DESCRIPTION OF THE DRAWINGS

Reference will now be made in detail to embodiments, examples of which are illustrated in the accompanying drawings, in which.

DESCRIPTION OF EMBODIMENTS

Embodiments of the present invention will now be described in detail with reference to the drawings. In the detailed description, numerous specific details are set forth in order to provide a thorough understanding of the present invention. However, it will be apparent to one of ordinary skill in the art that the present invention may be implemented without these specific details.

Figure 1:
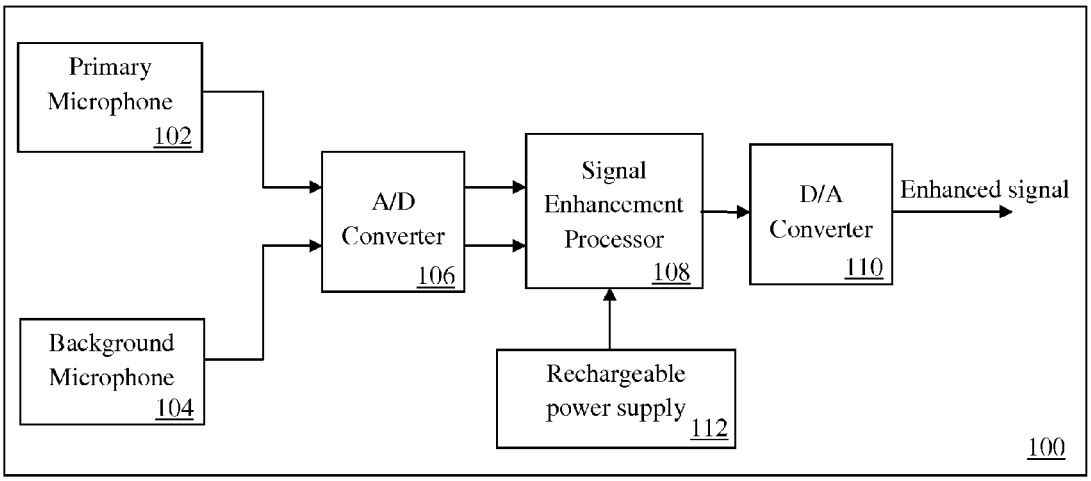
FIG. 1 illustrates a block diagram of a plug-in noise cancellation device according to an embodiment of the present invention.

FIG. 1 illustrates a block diagram of a plug-in noise cancellation device 100 according to an embodiment of the present invention. As shown in FIG. 1, the noise cancellation device 100 comprises a primary microphone 102, a background microphone 104, an analog-to-digital (A/D) converter 106, a signal enhancement processor 108, a digital-to-analog (D/A) converter 110 and a rechargeable power supply 112. The noise cancellation device 100 acquires two inputs respectively by the primary microphone 102 and the background microphone 104. Specifically, a first input is received by the primary microphone 102 from an external device (not shown) such as a stethoscope or a cell phone and includes a mixed sound signal containing a useful signal and a noise signal, while a second input is received by the background microphone 104 from the background environment and includes merely a background noise signal. The noise cancellation device 100 makes use of the dual microphone configuration to acquire the dynamically changing background noise signal as a reference signal for signal enhancement process. The analog mixed sound signal and background noise signal output from the primary microphone 102 and the background microphone 104 are converted into digitized signals in the A/D converter 106. Then the digitized signals are passed to the signal enhancement processor 108, in which the digitized mixed sound signal is subjected to adaptive filtering with the background noise signal as the reference signal so as to filter out the noise signal contained in the mixed sound signal and obtain the enhanced signal of high SNR. Finally, the enhanced signal output from the signal enhancement processor 108 is reconverted into analog signal by the D/A converter 110.

Figure 2:
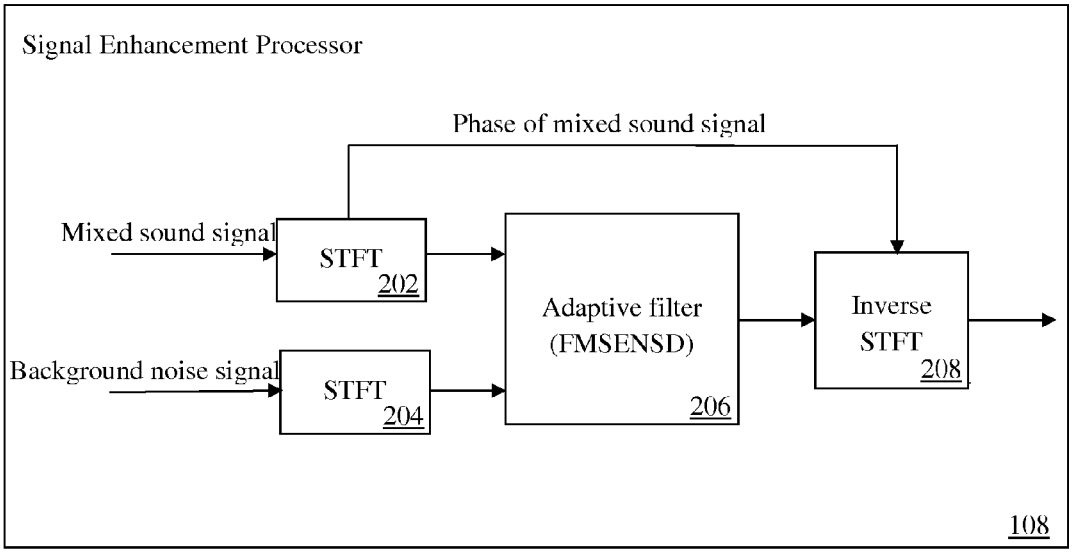
FIG. 2 illustrates an internal configuration of a signal enhancement processor in the plug-in noise cancellation device as shown in FIG. 1, according to an embodiment of the present invention.

The signal enhancement processor 108 is the most critical component of the noise cancellation device 100. FIG. 2 illustrates the detailed internal configuration of the signal enhancement processor 108 that comprises two short-time Fourier transformers (STFTs) 202, 204, an adaptive filter 206 and an Inverse STFT 208. According to an embodiment of the present invention, the signal enhancement processor 108 performs the adaptive filtering on incoming signals in accordance with a novel algorithm called Minimal Mean Squared Error in Frequency domain with N-coefficient and Signal Detection (FMSENSD). Unlike conventional adaptive filtering algorithms such as Least Mean Square (LMS), Normalized Least Mean Square (NLMS), and Recursive Least Square (RLS) that usually work in time domain, the adaptive algorithm FMSENSD works in frequency domain and achieves excellent sound quality. The detailed FMSENSD algorithm is as follows:

---

Algorithm FMSENSD
Input: x is the mixed sound signal; r is the reference noise signal (background noise only)
Output: e is the filtered sound
Parameters: nwin, noverlap, nfft, N (filter length)
Algorithm:

```
fx = spectrogram(x, nwin,noverlap,nfft);afx = abs(fx) //compute spectral magnitudes of mixed sound
fr = spectrogram(r,nwin,noverlap,nfft);afr = abs(fr) //compute spectral magnitudes of reference noise
for each band i    // estimate the channel response hh using all signal components in the mixed sound
    AFR_i = Toeplitz(afr_i,N)
    hh = (AFR_i^T AFR_i)^-1 AFR_i^T afx_i, afy_i = afr_i * hh
end
afe = afx − afy    //compute residual
nafe = smooth(afe.^2)
T = median(nafe)
o = nafe < T // extract silence regions
for each band i    // estimate the channel response hh again using noise only signal components
    AFR_i = Toeplitz(afr_i(o),N)
    hh = (AFR_i^T AFR_i)^-1 AFR_i^T afx_i(o), afy_i = afr_i * hh
end
afe = max(0,afx − afy)    // compute residual
e = overlap_add(afe,angle(fx),nwin,noverlap,nfft) //reconstruct time domain signals
```

---

Figure 3:
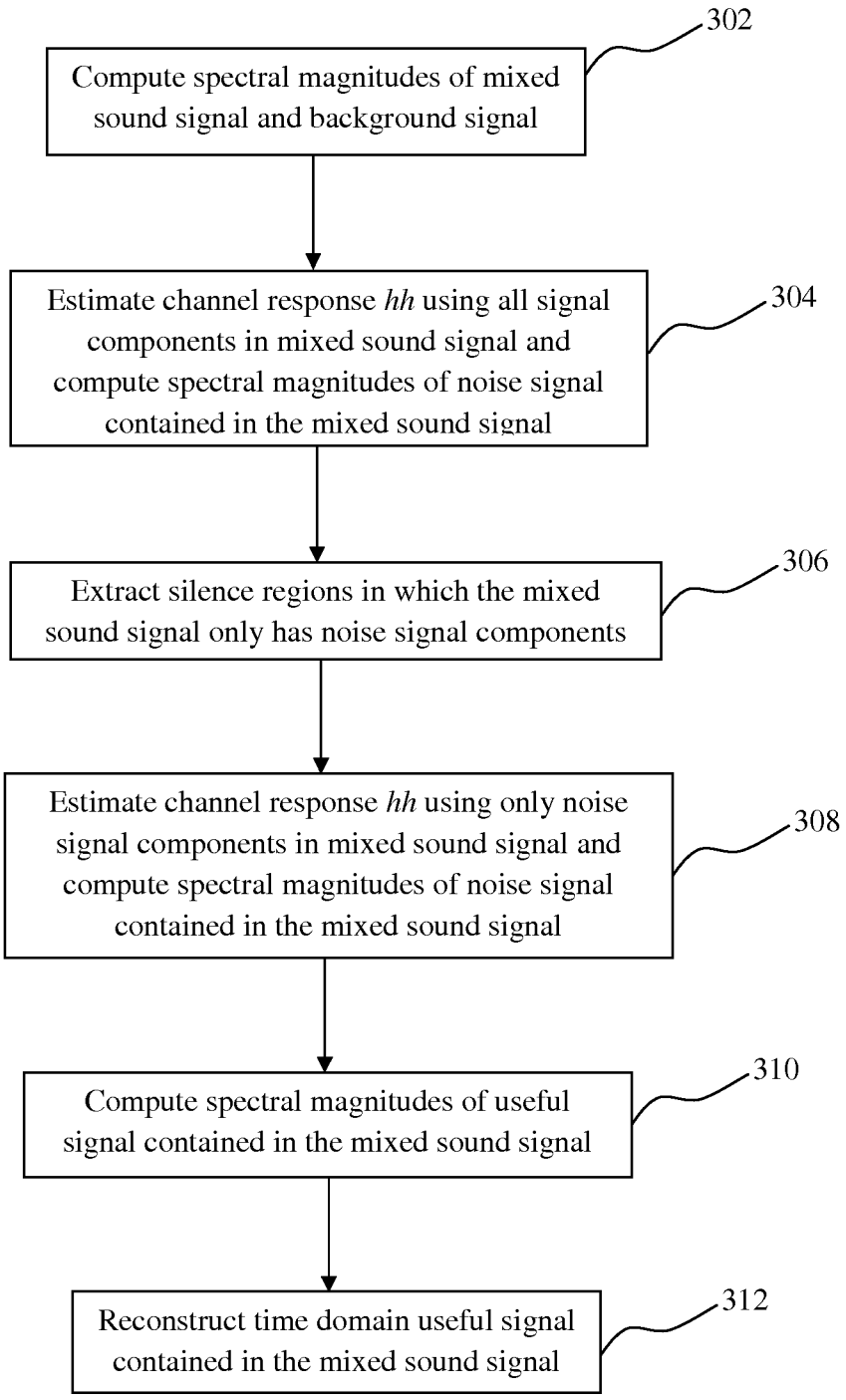
FIG. 3 is a flow chart that illustrates the process of the signal enhancement processor of FIG. 2 in accordance with a novel algorithm called Minimal Mean Squared Error in Frequency domain with N-coefficient and Signal Detection (FMSENSD), according to an embodiment of the present invention.

Hereinafter, the FMSENSD algorithm will be described in detail with reference to the flow chart in FIG. 3 that illustrates the process of the signal enhancement processor of FIG. 2 in accordance with the FMSENSD algorithm, according to an embodiment of the present invention. In the embodiment, the adaptive filtering is carried out in the frequency domain, so the mixed sound signal x and the reference noise signal r need to be processed by the STFTs 202, 204 respectively to compute the spectral magnitudes of these signals (step 302). Then, at step 304, the channel response hh in frequency domain can be estimated using all signal components in the mixed sound signal x that include useful signal components and noise signal components based on linear Minimum Mean Square Error (MMSE) estimation. Also, with the estimated channel response hh, the noise signal y contained in the mixed sound signal can be estimated by calculating the convolution of the estimated channel response hh and the reference noise signal r (step 304). Next, at step 306, the silence regions in which the mixed sound signal is estimated to merely have noise signal components can be extracted, and then at step 308, the channel response hh can be estimated again only using noise signal components in the mixed sound signal x and the noise signal y contained in the mixed sound signal x can be more accurately estimated by calculating the convolution of the estimated channel response hh and the reference noise signal r. After having the noise signal y estimated, the useful signal contained in the mixed sound signal x can be obtained by filtering out the noise signal y (step 310). Finally, at step 312, the useful signal in the mixed sound signal x processed in frequency domain can be subjected to the inverse Fourier transform in the Inverse STFT 208 so as to get the reconstructed time-domain useful signal to be output from the signal enhancement processor 108.

Figure 4:
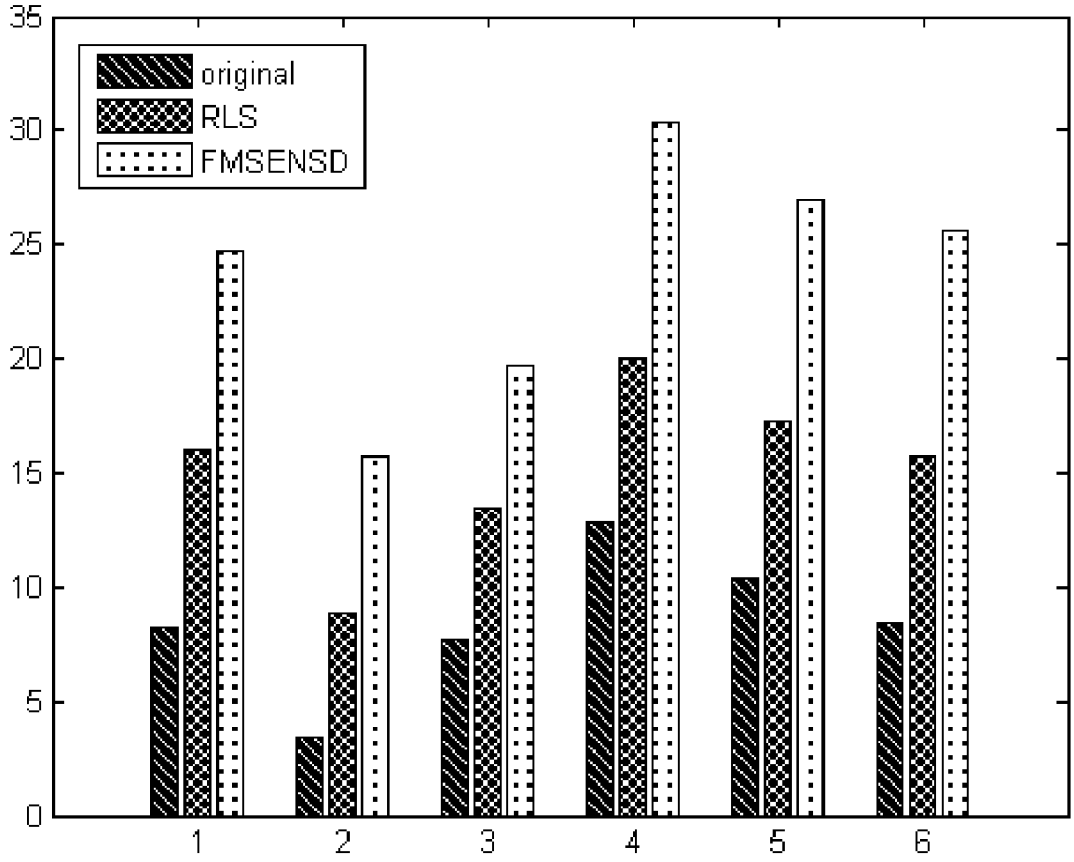
FIG. 4 illustrates the performance of the signal enhancement processor of FIG. 2 using the FMSENSD algorithm, as compared to the performance of a signal enhancement processor using a well-known algorithm called Recursive Least Square (RLS)

The FMSENSD algorithm is a high performance algorithm that converges fast and works very well under noisy conditions and reverberant environments. In particular, the filter length N is a design parameter, which can be adjusted by user to deal with different reverberant conditions. This is a key innovation of our algorithm. Moreover, FMSENSD requires much less computations as compared to RLS and hence is very suitable for real-time applications. Extensive experiments have been done for different applications such as auscultation enhancement in 80 dBA noisy environment, speech enhancement in 120 dBA noisy environment, and speech enhancement using cell phones (e.g. iPhone 4). For example, the FMSENSD algorithm can be applied to enhance auscultation in noisy environments such as International Space Station (ISS) where the noisy level can be more than 79 dBA. Conventional stethoscopes are designed for quiet environments (45 dBA) and hence they are not suitable for noisy environments. FIG. 4 demonstrates the performance of the signal enhancement processor using the FMSENSD algorithm under various environments, as compared to the performance of a signal enhancement processor using a well-known algorithm called Recursive Least Square (RLS). It can be seen that the FMSENSD algorithm performs significantly better than the RLS algorithm. Moreover, the computational complexity of the FMSENSD algorithm is much simpler than RLS.

Figure 5:
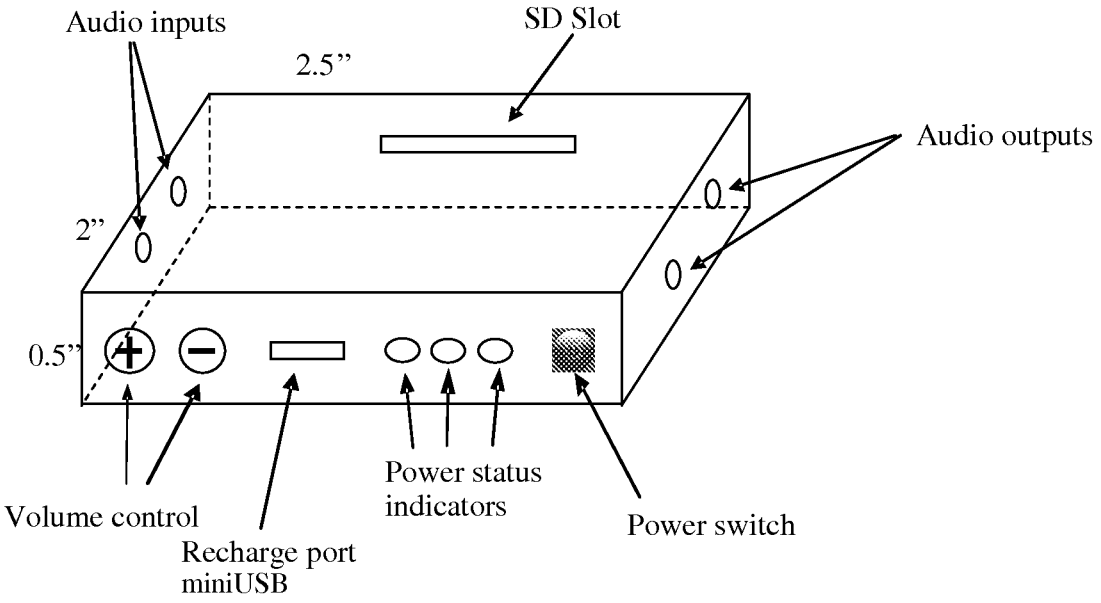
FIG. 5 illustrates an exemplary mechanical dimension and appearance of a compact plug-in noise cancellation device according to an embodiment of the present invention.

The noise cancellation device of the present invention has the advantages of compact model and low cost. FIG. 5 illustrates an exemplary mechanical dimension and appearance of the compact plug-in noise cancellation device according to an embodiment of the present invention. With the advent of fast processors, the size of the noise cancellation device may be similar to a USB portable drive (2.5" (length)×2" (width)× 0.5" (thickness)) and the cost may be less than 20 dollars in five years. In addition, the noise cancellation device of the present invention is a portable, light weight and plug-in device. It is very convenient to connect/disconnect the noise cancellation device to/from a system in a noisy environment based on actual needs.

With the forgoing described advantages, the noise cancellation device of the present invention is applicable to many applications such as biometrics (voiceprint), speech enhancement for construction workers, factory works, law enforcement agents, soldiers, doctors and cell phone users.

Figure 6:
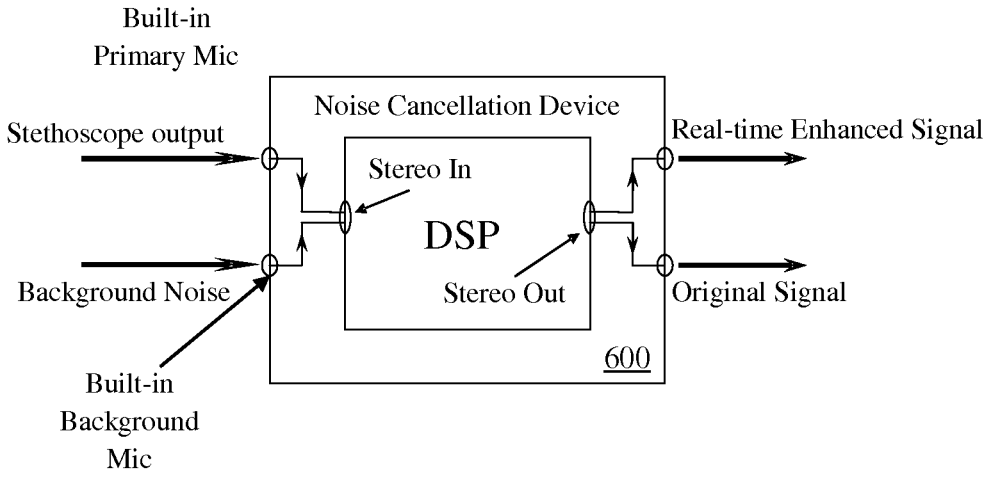
FIG. 6 schematically illustrates an application of a compact plug-in noise cancellation device for high performance auscultation according to an embodiment of the present invention.

FIG. 6 schematically illustrates an application of a compact plug-in noise cancellation device 600 for high performance auscultation according to an embodiment of the present invention. When a doctor performs auscultation on a patient in a noisy environment and realizes that the background noise will significantly affect the auscultation, he/she can bring out the noise cancellation device 600 of the present invention and connect the stethoscope output to the primary microphone of the noise cancellation device 600. When the connected noise cancellation device 600 is turned on, both the stethoscope output sound and the background noise will be simultaneously acquired by the noise cancellation device 600. Then, as above described, the noise cancellation device 600 will perform the adaptive filtering based on the foregoing FMSENSD algorithm on the stethoscope output sound to generate filtered and enhanced output. In the embodiment, the noise cancellation device 600 provides two outputs: unfiltered output (original signal) and filtered output (enhanced signal). During the auscultation process, the doctor can choose to listen to either the unfiltered or filtered output from the noise cancellation device 600 and makes a judicious diagnosis. Also, the outputs of the noise cancellation device 600 can be connected to a PC or other devices for storage.

The noise cancellation device of the present invention can also be employed for speech enhancement in battlefield environments. When soldiers call for close air support (CAS), they are normally very near the frontline where mortar explosions, machine guns, and other types of background noises are overwhelming. Communication quality may be compromised. Conventional speech enhancement techniques can only deal with stationary noise, but not intermittent and unpredictable noise such as explosions. Moreover, conventional techniques cannot deal with intermittent and large amplitude noise where the SNR may be less than zero, that is, the amplitude of the useful signal is much less than that of the background noise. Similar to the above auscultation enhancement application, the noise cancellation device of the present invention can be utilized to achieve speech enhancement in battlefield environments. Similar to that illustrated in FIG. 6, the primary microphone of the noise cancellation device receives mixed sound signal including voice signal from a soldier and noise signal in the noisy environment, and synchronously the background microphone of the noise cancellation device receives background noise signal. Then the mixed sound signal can be processed with the background noise signal as reference noise signal to obtain the enhanced voice signal. In an experiment, the SNR in the primary microphone is −20.1837 dB and the SNR in the background microphone is −22.3265 dB. Both SNRs are very low. The speech is not intelligible in such a battlefield environment. However, after speech enhancement by the noise cancellation device of the present invention, the speech is recovered quite clearly (the SNR becomes 22.2848 dB).

Figure 7:
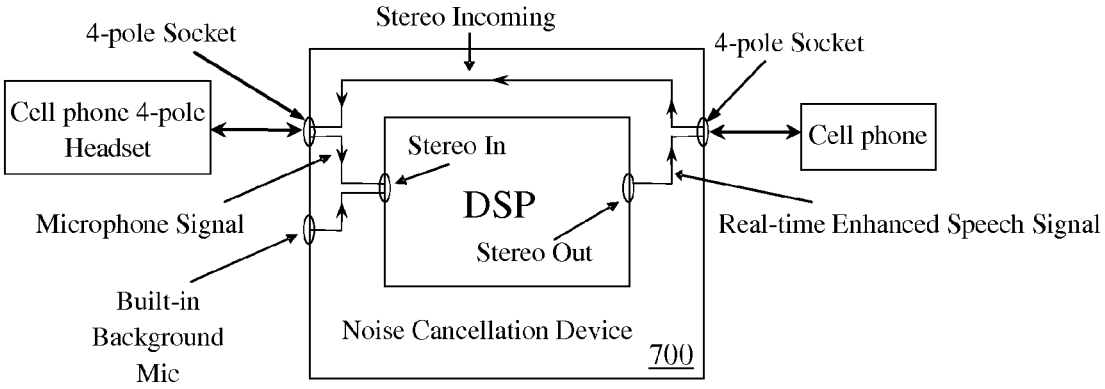
FIG. 7 schematically illustrates an application of a compact plug-in noise cancellation device for bi-directional phone communication according to an embodiment of the present invention.

In the foregoing described auscultation enhancement application and speech enhancement application in battlefield environments, the communication is only in one direction. In cell phone communications, bi-directional communications are required. Therefore, a variant of the noise cancellation of the present invention is needed so as to be applied for signal enhancement in cell phone communications. FIG. 7 schematically illustrates an application of a plug-in noise cancellation device 700 for bi-directional cell phone communication according to an embodiment of the present invention. As can be seen from FIG. 7, the noise cancellation device 700 has a built-in background microphone for acquiring background noise signals and a DSP board for realizing signal enhancement with the FMSENSD algorithm, which are the same as those of the noise cancellation device 600 shown in FIG. 6. However, the noise cancellation device 700 may not include a built-in primary microphone for receiving the mixed sound signal. Instead, two 4-pole sockets are provided in the noise cancellation device 700. In the setup of the embodiment, one 4-pole socket is connected to a cell phone 4-pole headset for acquiring microphone signal from the cell phone 4-pole headset and transmitting the stereo signal from a cell phone to the cell phone 4-pole headset, while the other 4-pole socket is connected to the cell phone for transmitting real-time enhanced speech signal to the cell phone and receiving stereo signal from the cell phone. Also, as illustrated in FIG. 7, a transmission path is provided between the two 4-pole sockets for transmitting stereo signal from the cell phone to the cell phone 4-pole headset. With such a configuration, the noise cancellation device 700 can be connected between a cell phone and a cell phone 4-pole headset to generate and transmit the real-time enhanced speech signal to the cell phone and also receive and convey the stereo signal from the cell phone to the cell phone 4-pole headset. In this way, a bi-direction communication is accomplished.

While the process described above includes a number of operations that appear to occur in a specific order, it should be apparent that these processes may include more or fewer operations, which may be executed serially or in parallel. Furthermore, the foregoing description provides a disclosure of the invention concerning its implementation, which is not limited by the detailed description but only by the scope of the appended claims. All those other aspects of the invention that will become apparent to a person of skill in the art, who has read the foregoing, are within the scope of the invention and of the following claims.

What is claimed is:

1. A noise cancellation device, wherein said noise cancellation device is a portable light weight and plug-in device suitable for real-time applications in a noisy environment based on actual needs, and comprising a primary microphone;

a background microphone;

an analog-to-digital converter (ADC);

a signal enhancement processor;

a digital-to-analog converter (DAC); and a rechargeable power supply; wherein said signal enhancement processor further comprises two short-time Fourier transforms (STFTs), an adaptive filter and an Inverse STFT and said signal enhancement processor conducts a function of adaptive filtering with the background noise signal as the reference signal so as to filter out the noise signal contained in the mixed sound signal and obtain the enhanced signal of high signal-to-noise ratio (SNR);

wherein said noise cancellation device is used in a bi-directional communication comprising cell phone communications, two 4-pole sockets are provided in said noise cancellation device, one 4-pole socket is connected to a cell phone 4-pole headset for acquiring a microphone signal from the cell phone 4-pole headset and transmitting a stereo signal from a cell phone to the cell phone 4-pole headset, the other 4-pole socket is connected to the cell phone for transmitting a real-time enhanced speech signal to the cell phone and receiving the stereo signal from the cell phone, and there is a transmission path between the two 4-pole sockets for transmitting the stereo signal from the cell phone to the cell phone 4-pole headset.

2. The noise cancellation device of claim 1, wherein said signal enhancement processor conducts said function of adaptive filtering in frequency domain with an algorithm of Minimal Mean Squared Error in Frequency domain with N-coefficient and Signal Detection (FMSENSD) comprising an input comprising a mixed sound signal and a reference noise signal;

an output comprising a filtered sound;

parameters comprising a filter length;

an algorithm, comprising:

computing spectral magnitudes of mixed sound;

computing spectral magnitudes of reference noise;

estimating a channel response a first time using signal components in the mixed sound;

computing a residual a first time;

extracting silence regions;

estimating the channel response a second time using noise only signal components;

computing the residual a second time;

reconstructing time domain signals;

wherein said filter length is a design parameter which can be adjusted by a user based on reverberant conditions.

* * * * *